US006096987A

United States Patent [19]

Krueger et al.

[11] Patent Number: 6,096,987

[45] Date of Patent: Aug. 1, 2000

[54] SWITCH HARNESS ASSEMBLY FOR GAS BURNER MANIFOLD

[75] Inventors: Donald M. Krueger, Westchester; John A. Kososki, Downers Grove, both of Ill.

[73] Assignee: Ranco Incorporated of Delaware, Wilmington, Del.

[21] Appl. No.: 08/289,679

[22] Filed: Aug. 12, 1994

[51] Int. Cl.[7] ..... H01H 21/80; H01H 9/06

[52] U.S. Cl. ..... 200/61.86; 200/6 BB

[58] Field of Search ..... 200/4, 6 R, 6 B, 200/6 BB, 6 C, 11 R, 11 G, 11 H, 11 K, 19 R, 27 R, 21, 30 R, 61.85, 61.86, 293, 302.1; 431/256, 257, 255

[56] References Cited

U.S. PATENT DOCUMENTS

| | | | |
|---|---|---|---|
| 3,502,835 | 3/1970 | Batcheller | 200/154 |
| 3,971,904 | 7/1976 | Ward | 200/6 BB |
| 4,019,855 | 4/1977 | Camillo | 431/256 |
| 4,081,641 | 3/1978 | Piber | 200/153 LA |
| 4,249,047 | 2/1981 | Huff et al. | 200/61.86 |
| 4,342,886 | 8/1982 | Demi | 200/61.86 |
| 4,612,423 | 9/1986 | Munroe | 200/16 R |

*Primary Examiner*—Michael Friedhofer

*Attorney, Agent, or Firm*—Terrence Martin; Jules Jay Morris; Sean D. Detweiler

[57] ABSTRACT

A switch harness assembly for the manually operated burner control valves on a range top gas burner manifold. A pair of continuous uninterrupted parallel electrical lines have individual cam operated igniter switches each adapted for rotary driving engagement with the shaft from one of the burner valves. Each switch has a pair of contact members with portions which pierce the insulation of one of the pair of leads for making electrical connection. The switch housing is assembled over the leads and cam drum. Grease provides a seal between the cam drum and housing to improve foodstuff spill resistance and an annular grease trap about the cam drum protects the contacts from the grease.

20 Claims, 3 Drawing Sheets

SWITCH HARNESS ASSEMBLY FOR GAS BURNER MANIFOLD

BACKGROUND OF THE INVENTION

The present invention relates to switches of the type which are associated with burner control valves employed on gaseous fuel burners utilized in cooking appliances and particularly range top burners. Typically, range top burners are supplied from a fuel gas manifold with individual user operated control valves provided for selecting the desired burner to be operated for cooking.

In the more common cooking range constructions, the range top burner manifold extends along the front of the range top cabinet with the individual burner valves mounted therealong with the valve operating shaft extending through the cabinet and provided with a control knob for enabling the user to turn the burner valve on and off and to adjust the flow through the valve to produce the desired amount of flame at the burner. In such range top burner applications, it is commonplace to have a rotary cam provided on the burner valve shaft such that the cam is operative to close a switch upon rotation of the valve from the "OFF" position; and, typically the switch is operative to complete a circuit to energize a spark igniter for the burner. Thus, in the manufacture and assembly of the range, it is required to have a switch provided for each of the top burner valves and the attendant wiring associated therewith for connection to the igniter circuitry.

In the manufacture of ranges in high volume for the household cooking appliance market, it has been found somewhat cumbersome and costly to provide for individual mounting of the burner valve igniter switches and to provide for individual wire terminal connections for each of the burner valve switches during the assembly operations for the range.

In addition, the individual burner valve switches employed in the typical household cooking range top are susceptible to flooding with liquified foodstuffs from boil-overs and spillage. This flooding of the switches has caused leakage of the liquified matter into the switch and has caused corrosion and failure of the switch contacts in service. Therefore, it has been desired to provide not only a simplified way or means of assembling and wiring top burner valve switches, but it has also been desired to improve the resistance of such switches to boil-over and spillage.

SUMMARY OF THE INVENTION

It is an object of the present invention to provide for reduced manufacturing cost in providing wiring connections to switches employed on the individual user operated control valves on a range top gas burner manifold.

It is another object of the present invention to provide reduced manufacturing costs in wiring switches employed on range top gas burner manifold valves and to provide such improved switches having improved resistance to foodstuff spillage.

The present invention provides an assembly of a plurality of gaseous fuel burner switches and the associated wiring assembled as an integral unit. The switches are assembled over a pair of continuous uninterrupted wire leads so as to make electrical contact with the leads resulting in the switches being electrically in parallel with the wire leads. The switches are spaced along the wire leads at the appropriate stations to enable the switches to each be assembled over a correspondingly spaced burner valve shaft on a range top burner manifold. The switches each have a hollow cam drum through which the burner valve shaft is inserted and engaged for turning the cam drum with the burner valve shaft upon user rotation of the valve shaft. The switches each have the electrical contact therein provided with portions which pierce the insulation and contact the conductors of the wires without severing the wire conductors. In one embodiment the switch housings are snap locked together and in another embodiment are fused by weldment. Each switch has the cam drum thereof provided with a grease seal thereabout to resist leakage from boil-over and spillage; and, an annular grease trap is provided about the grease seal to prevent the grease from entering the interior of the switch housing and fouling the switch contacts. The present invention thus permits assembly of a plurality of gas burner valve switches onto a pair of continuous electrical leads to provide an integral harness for assembly onto the manifold burner valve in a gas range.

DETAILED DESCRIPTION

Figure 1:
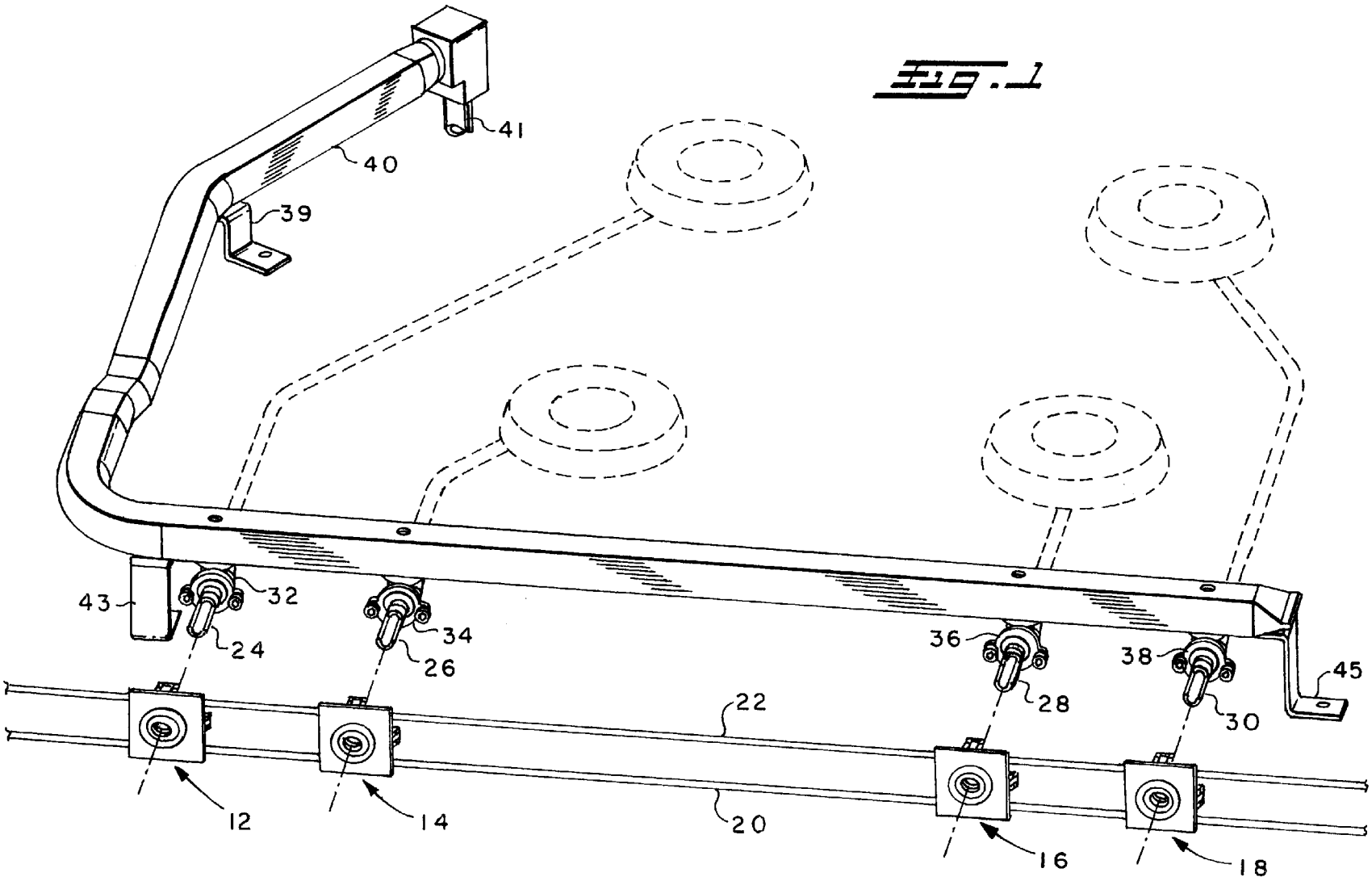
FIG. 1 is a perspective view of the switch harness assembly shown positioned for installation on a gas burner valve manifold with burners shown in dashed outline.

Referring to FIG. 1, the switch and wiring assemblies indicated generally at 10 as having a plurality of switches denoted generally by reference numerals 12,14,16,18 integrally assembled onto a pair of continuous electrical leads 20,22 which extend uninterruptedly through the switches. Each of the switches is shown as adapted for assembly onto one of the shafts denoted respectively by reference numerals 24,26,28,30 extending from respectively individual burner valves denoted by reference numerals 32,34,36,38. The burners are shown in dashed outline in FIG. 1. The burner valves are each mounted to receive gaseous fuel from an outlet provided on the burner valve manifold 40 which is supported by brackets 39,43,45 in a typical range installation; and, manifold 40 has an inlet 41 adapted for connection to a gas supply. Each of the burner valves has an outlet that is connected to a burner inlet tube shown in dashed outline.

Figure 2:
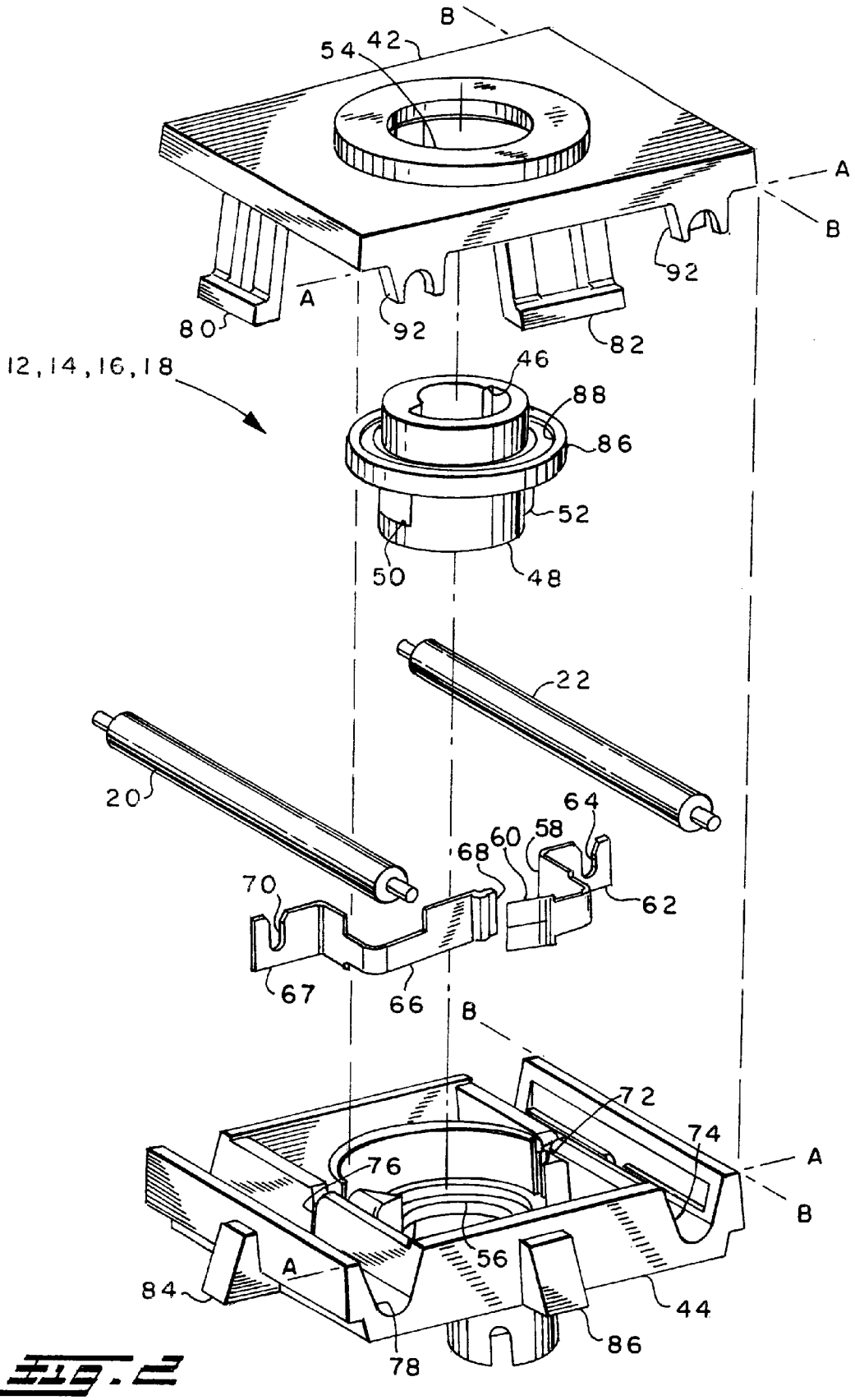
FIG. 2 is a is an exploded view of one embodiment of the switches of the present invention.
Figure 3:
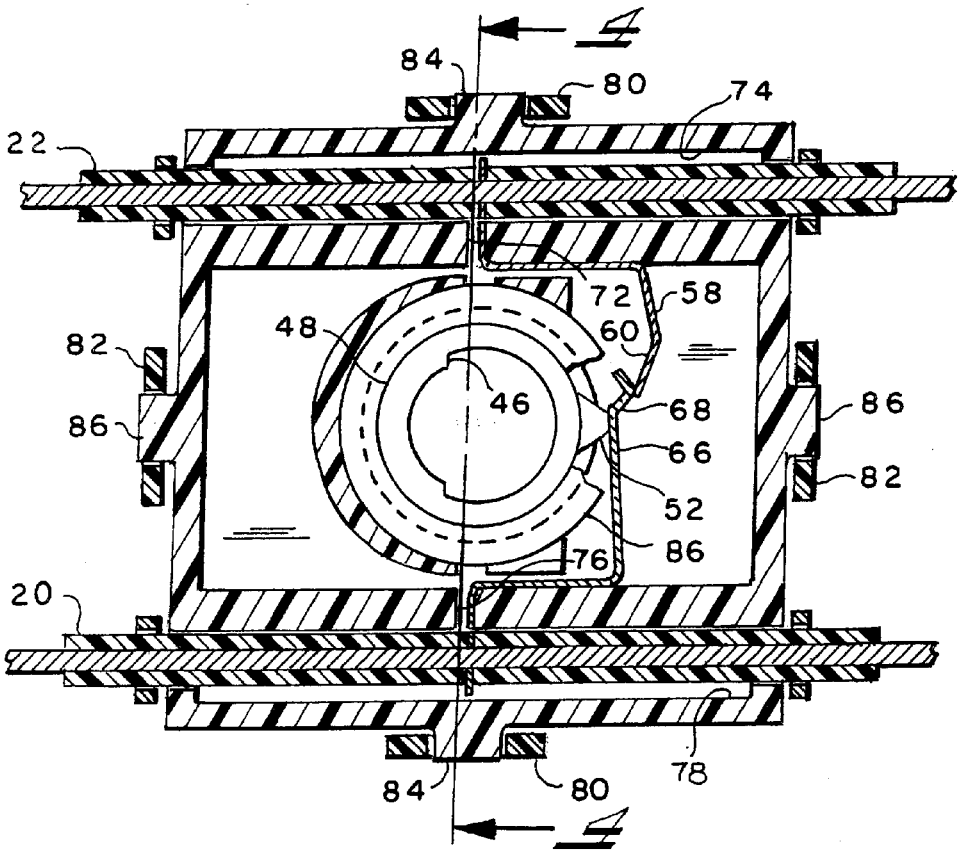
FIG. 3 is a section view through the plane of the electrical leads for one of the switches of FIG. 2.
Figure 4:
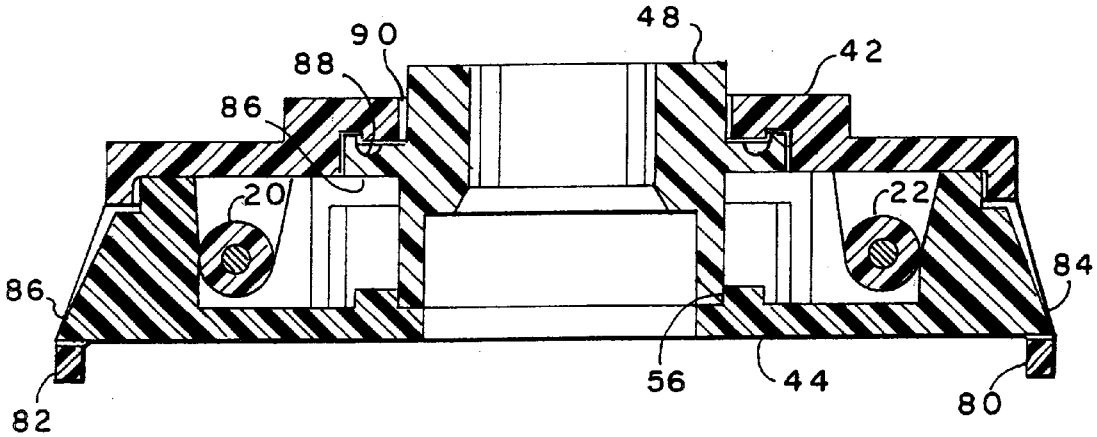
FIG. 4 is a section view taken along section indicating lines 4—4 of FIG. 3.

Referring to FIGS. 2, 3 and 4, the construction of the switches 12, 14, 16, 18 is shown typically in exploded view with an upper and lower housing shell 42,44 which are joined together along the surfaces lying in the parting plane denoted by the lines A—A and B—B in FIG. 2. Although the parting surfaces lie in a plane in the illustrated embodiment, it will be understood that the parting surfaces may be staggered or define a curve surface as desired.

A cam drum 46 has a bore centrally therethrough and preferably having a "D"-shaped cross-section as indicated by reference numeral 46 and is adapted to have one of the valve shafts 24,26,28,30 received therethrough. Each of the valve shafts has a corresponding flat thereon to drivingly engage the surface 46. The drum 48 has a pair of cam surfaces 50,52 disposed thereon, preferably oppositely; and, the drum 48 has one end journalled in a central aperture 54 provided in the upper shell with the lower end of the drum 48 journalled in an aperture 56 formed in the lower shell.

The lower shell 44 has a first contact terminal member 58 received therein with a contact forming end portion 60 and a wire connecting end portion 62 disposed at the opposite end thereof, and the wire connecting portion 62 has a slot 64 formed therein which is operative to have the wire lead 62 pressed therein such that the sides of the slot 64 pierce the insulation and contact the inner conductor of the lead 22.

The lower shell 44 also has a second contact forming member 66 which has one end forming a contact blade 68 which follows the cam surfaces 50,52 for making a breaking against the contact 60. The opposite end of the blade member 66 has a slot 70 formed therein which is sized to have the electrical lead 20 received therein such that the sides of the slot 70 pierce the insulation and make contact with the inner electrical conductor of the lead 20.

The end portion 62 of contact member 58 extends through a slot 72 formed in the lower housing shell to permit the end 62 of the conductor to extend into a groove 74 provided in the shell for receiving lead 22. Similarly, a slot 76 is provided in the opposite side of the housing shell for permitting the portion 67 of contact member 66 to extend into a groove 78 provided in the shell for receiving therein the electrical lead 20.

The upper shell 42 is received over the shell 44 and secured thereon by snap locking such as by slotted tabs 80,82 engaging corresponding lugs or projections 84,86 provided on the lower housing shell.

In the embodiment illustrated in FIG. 2, it has been found desirable to apply a coating of sealant on the surfaces of the parting plane to eliminate leakage into the interior of the switch housing when the upper shell is attached to the lower shell.

Referring to FIGS. 3 and 4 the cam drum 48 has an enlarged annular flange 86 which has formed on the upper face thereof as shown in FIG. 2 an annular groove 88 which serves as a grease trap for sealing grease applied in the inner periphery of the aperture 54 in the upper cover as denoted by the reference numeral 90 in FIG. 4.

It will be understood that if desired, the lugs 84,86 and the tabs 82,80 may be omitted and the upper shell 42 may be secured to the lower shell 44 along the parting plane by weldment as, for example, ultrasonic welding which can eliminate the need for a sealant at the parting surfaces.

Referring to FIG. 2, a plurality of depending baffles and/or drip tabs denoted by reference numeral 92 are provided on the upper shell over the electrical conductors 20,22 as they enter and exit from the groove 78,74. If desired, the baffles and/or drip tabs may be configured to act as strain relief devices by pressing upon the insulation of the electrical leads as the upper shell 42 is assembled onto the lower shell 44.

The present invention provides an integrally assembled switch wiring harness for plural cam operated switches employed for engagement and actuation by the shafts of range top gas burner manifold valves. The switches each employ contact members which pierce the insulation of a pair of continuous uninterrupted leads for electrical contact. A grease seal is provided between the switch housing and rotatable switch cam with an annular grease trap therearound to protect the switch contacts.

Although the present invention has been described hereinabove with respect to the illustrated embodiments, it will be understood that the invention is capable of modification and variation and is limited only by the scope of the following claims.

We claim:

1. An integral switch and wiring assembly for a gas burner valve manifold comprising:

(a) a pair of insulated continuous uninterupted electrical conductors having insulation thereon disposed in generally spaced parallel arrangement; and, (b) a plurality of cam operated switches disposed at different stations along said conductors, each of said switches having:

(i) a first and second housing shell joined about a parting line with said conductors passing continuously therethrough, (ii) a cam journalled for rotation on said shells and adapted for drivingly engaging a gas valve shaft, (iii) a first electrical contact member having portions thereof piercing said insulation and contacting one of said conductors, (iv) a second electrical contact member having portions thereof piercing said insulation and contacting the other of said conductors, said second contact member having other portions moveable for making and breaking with said first contact in response to said rotation of said cam.

2. The assembly defined in claim 1, wherein said journalling includes a grease seal and an annular well disposed thereabout for trapping grease from entering said shells.

3. The assembly defined in claim 1, wherein said first and second shells are joined by a technique selected from the group consisting of (a) snap-locking or (b) weldment.

4. The assembly defined in claim 1, wherein said cam has an aperture therethrough for receiving a burner valve shaft therethrough.

5. A method of making an integral switch and wiring assembly for a plural valved gas burner manifold comprising:

(a) disposing a pair of continuous uninterrupted insulated electrical leads in generally spaced parallel arrangement;

(b) disposing an electrical contact member on each of said leads;

(c) disposing a first and second shell over said leads and clamping said shells together and piercing each of said leads with a certain portion of said contact member at a certain station along said conductor; and, (d) journalling a cam for rotation on said shells and rotating said cam and effecting making and breaking of said contact member.

6. The method defined in claim 5, wherein said step of disposing said contacts includes inserting said contacts in one of said shells.

7. The method defined in claim 5, wherein said step of journalling includes grease sealing said shells about said cam.

8. The method defined in claim 5, wherein said step of journalling includes grease sealing said shells about said cam and forming an annular grease trap about said seal.

9. The method defined in claim 5, further comprising engaging said cam with a burner valve shaft and for rotating said cam by said shaft.

10. The method defined in claim 5, wherein said clamping includes sealing between said shells.

11. The method defined in claim 5, further comprising disposing a plurality of contacts, shells and cams at plural stations along said conductors.

12. A gas burner manifold assembly comprising:

(a) a gas manifold having an inlet and plural outlets;

(b) a plurality of burner valves each having its inlet connected to one of said plural outlets and each having a shaft operable upon user rotation to effect opening and closing thereof;

(c) a plurality of switches, each housing a rotary cam and disposed to operatively engage one of said burner valve shafts for rotation therewith and a moveable follower member operable to follow said cam and effect opening and closing a set of switch contacts in said switch; and, (d) a pair of insulated electrically leads extending continuously uninterrupted through said plurality of switches and electrically connecting said switches electrically in parallel thereacross.

13. The assembly defined in claim 12, wherein each of said switches has a pair of housing shells joined along a parting line.

14. The assembly defined in claim 12, wherein each of said switches has portions of said contacts piercing one of said leads.

15. The assembly defined in claim 12, wherein said cam is grease sealed in each of said switches and includes an annular grease trap for protecting said contacts.

16. The assembly defined in claim 12, wherein each of said switches has a housing comprising first and second shells joined together along a parting line.

17. The assembly defined in claim 12, wherein each of said switches has a housing comprising first and second shells snap-locked together.

18. The assembly defined in claim 12, wherein each of said switches has a housing comprising first and second shells joined together by weldment.

19. The assembly defined in claim 12, wherein each of said switches includes a baffle for entry and exit of said conductors in the switch housing.

20. The assembly defined in claim 12, wherein each of said switches includes a drip tab for entry and exit of said conductors in the switch housing.

* * * * *